US008096141B2

(12) United States Patent
VanderZee

(10) Patent No.: US 8,096,141 B2
(45) Date of Patent: Jan. 17, 2012

(54) SUPERHEAT CONTROL BY PRESSURE RATIO

(75) Inventor: Joel C. VanderZee, La Crosse, WI (US)

(73) Assignee: Trane International Inc., Piscataway, NJ (US)

( * ) Notice: Subject to any disclaimer, the term of this patent is extended or adjusted under 35 U.S.C. 154(b) by 1813 days.

(21) Appl. No.: 11/042,615

(22) Filed: Jan. 25, 2005

(65) Prior Publication Data

US 2006/0162358 A1 Jul. 27, 2006

(51) Int. Cl.
*F25B 21/04* (2006.01)

(52) U.S. Cl. ..... 62/225; 62/210; 62/212; 62/222; 62/224

(58) Field of Classification Search ..... 62/210, 62/212, 224, 225, 222
See application file for complete search history.

(56) References Cited

U.S. PATENT DOCUMENTS

| | | | | |
|---|---|---|---|---|
| 4,505,125 | A * | 3/1985 | Baglione | 62/209 |
| 4,523,435 | A | 6/1985 | Lord | |
| 4,527,399 | A | 7/1985 | Lord | |
| 5,067,556 | A | 11/1991 | Fudono et al. | |
| 5,187,944 | A | 2/1993 | Jarosch | |
| 5,419,146 | A | 5/1995 | Sikik et al. | |
| 5,809,794 | A | 9/1998 | Sibik et al. | |
| 5,950,443 | A | 9/1999 | Meyer et al. | |
| 5,987,907 | A | 11/1999 | Morimoto et al. | |
| 6,032,473 | A | 3/2000 | Morimoto et al. | |
| 6,050,098 | A | 4/2000 | Meyer et al. | |
| 6,068,028 | A * | 5/2000 | De Ro et al. | 139/452 |
| 6,085,532 | A | 7/2000 | Sibik | |
| 6,141,981 | A * | 11/2000 | Reason et al. | 62/225 |
| 6,625,997 | B1 * | 9/2003 | Schultz | 62/186 |
| 6,701,725 | B2 * | 3/2004 | Rossi et al. | 62/125 |
| 6,854,285 | B2 * | 2/2005 | Jessen | 62/225 |
| 7,290,402 | B1 * | 11/2007 | Bailey | 62/225 |
| 2004/0107716 | A1 * | 6/2004 | Hirota | 62/228.5 |
| 2004/0144112 | A1 * | 7/2004 | He et al. | 62/225 |

FOREIGN PATENT DOCUMENTS

| | | | |
|---|---|---|---|
| JP | 05034023 A | * | 2/1993 |
| JP | 09229494 A | * | 9/1997 |

OTHER PUBLICATIONS

Yunus A. Cengel, Michael A. Boles; Thermodynamics (Fourth Edition); Nov. 27, 2001; McGraw-Hill Science/Engineering/Math; Chapter 4.*

Cenegal et al., (Thermodynamics), 1998, WCB/McGraw-Hill, Third Edition, see pp. 15 and 76-79.*

* cited by examiner

*Primary Examiner* — Frantz Jules
*Assistant Examiner* — Azim Rahim
(74) *Attorney, Agent, or Firm* — William O'Driscoll

(57) ABSTRACT

A control method regulates an electronic expansion valve of a chiller to maintain the refrigerant leaving a DX evaporator at a desired or target superheat that is minimally above saturation. The expansion valve is controlled to convey a desired mass flow rate, wherein valve adjustments are based on the actual mass flow rate times a ratio of a desired saturation pressure to the suction pressure of the chiller. The suction temperature helps determine the desired saturation pressure. A temperature-related variable is asymmetrically filtered to provide the expansion valve with appropriate responsiveness depending on whether the chiller is operating in a superheated range, a saturation range, or in a desired range between the two.

13 Claims, 4 Drawing Sheets

SUPERHEAT CONTROL BY PRESSURE RATIO

BACKGROUND OF THE INVENTION

1. Field of the Invention

The subject invention generally pertains to the control of air conditioners and heat pumps that have a direct-expansion evaporator (DX evaporator), and the invention more specifically pertains to maintaining the refrigerant leaving the evaporator at a desired minimal level of superheat.

2. Description of Related Art

Many refrigerant systems (chillers) have a DX evaporator in which a refrigerant absorbs heat while expanding from a liquid to a gaseous state directly inside the evaporator. The absorbed heat can cool air supplied to a comfort zone or cool an intermediate fluid such as chilled water. If the chiller functions as a heat pump, heat absorbed by the evaporator can be released to the comfort zone by way of a condenser.

The heat transfer coefficient across the tube walls of a DX evaporator is generally greatest when the refrigerant inside the tubes is saturated, partially liquid, rather than superheated to a gas. Liquid refrigerant, unfortunately, can damage a compressor, which draws the refrigerant from the evaporator. So ideally, the refrigerant enters the DX evaporator as a liquid and is not completely vaporized until just prior to leaving for the inlet of the compressor.

To this end, expansion valves, which controllably feed refrigerant from the condenser into the evaporator, are controlled so as to achieve a desired minimal amount of superheat within the evaporator. Examples of superheat-related controllers are disclosed in U.S. Pat. Nos. 4,505,125; 4,523,435; 4,527,399; 5,067,556; 5,187,944; 5,987,907 and 6,032,473. There is a common problem, however, facing perhaps all superheat-related controllers.

During steady state operation near a desired minimal superheat condition, the expansion valve controller preferably has a relatively low gain or response, as a slight adjustment to the opening or closing of the expansion valve can have a dramatic effect on the degree of superheat. The chiller, however, may not always be operating at this optimum steady state condition. Although a slight movement of the expansion valve can produce an appropriate change in superheat when operating just above the desired saturation point, that same amount of movement in opening may be insufficient when operating at greater levels of superheat. Thus, an expansion valve "tuned" for optimum response when operating at slightly above saturation may be too sluggish under conditions of greater superheat or no superheat (in saturation).

One conceivable solution may be to attempt identifying the nonlinear relationship between the amount of superheat and the opening of the expansion valve and adjust the response of the valve accordingly. The nonlinear relationship, however, is not necessarily a static relationship, particularly in cases where the chiller has varying load capability. Many systems vary the load by selectively unloading a compressor, selectively operating multiple compressors, selectively energizing multiple evaporator fans, varying the speed of an evaporator fan, etc. A controller could monitor such load-varying events and try to adjust the expansion valve's response accordingly, but such an approach becomes a daunting challenge, as the effect that each of these events has on the superheat needs to be accurately quantified, not only for when the events occur alone but also when they occur in various combinations with each other.

Consequently, a need exists for a better method of controlling the operation of an expansion valve to maintain a desired minimal level of superheat over widely varying load conditions.

SUMMARY OF THE INVENTION

A primary object of the invention is to maintain the refrigerant leaving an evaporator at a desired level of superheat.

Another object of some embodiments is to achieve the desired superheat by controlling the suction pressure of a chiller.

Another object of some embodiments is to dampen or filter (digitally or otherwise) the reading of the suction temperature to slow down the increase in suction pressure.

Another object of some embodiments is to asymmetrically filter a temperature-related variable to avoid saturation (between the evaporator and the compressor inlet) and to allow rapid response to load reductions, which tend to reduce the superheat.

Another object of some embodiments is to adjust an electronic expansion valve based on a pressure ratio of a desired saturation pressure divided by the suction pressure.

Another object of some embodiments is to determine a desired or target mass flow rate and an actual refrigerant flow rate through an electronic expansion valve, or through a refrigerant-conveying structure connected in series therewith (e.g., evaporator, condenser, compressor, conduit, etc.), and control the expansion valve accordingly.

Another object of some embodiments is to determine a target mass flow rate based upon the suction pressure and the suction temperature, wherein the suction temperature helps determine a desired saturation temperature, the desired saturation temperature helps determine a desired saturation pressure, and the desired saturation pressure helps determine the target mass flow rate.

Another object of some embodiments is to determine the actual mass flow rate through an expansion valve by sensing the pressure drop across the valve and multiplying the square root of that times a flow coefficient of the valve, wherein the flow coefficient is based on the physical characteristics of the valve and the degree to which a controller has commanded the valve to open.

Another object of some embodiments is to control an expansion valve more rapidly (higher gain, larger response) during superheated operation than during desired superheat operation, and to control the expansion valve less rapidly during superheated operation than during saturation operation. Saturation operation is when the suction temperature is at the saturation temperature, superheated operation is when the suction temperature is above a target temperature defined as the saturation temperature plus a desired superheat, and desired superheat operation is when the chiller is operating between superheated and saturation operation.

One or more of these and/or other objects of the invention are provided by a method that maintains the refrigerant leaving an evaporator at a desired level of superheat by adjusting an electronic expansion valve in response to sensing a chiller's suction pressure and temperature.

BRIEF DESCRIPTIONS OF THE DRAWINGS

DESCRIPTION OF THE PREFERRED EMBODIMENT

Figure 1:
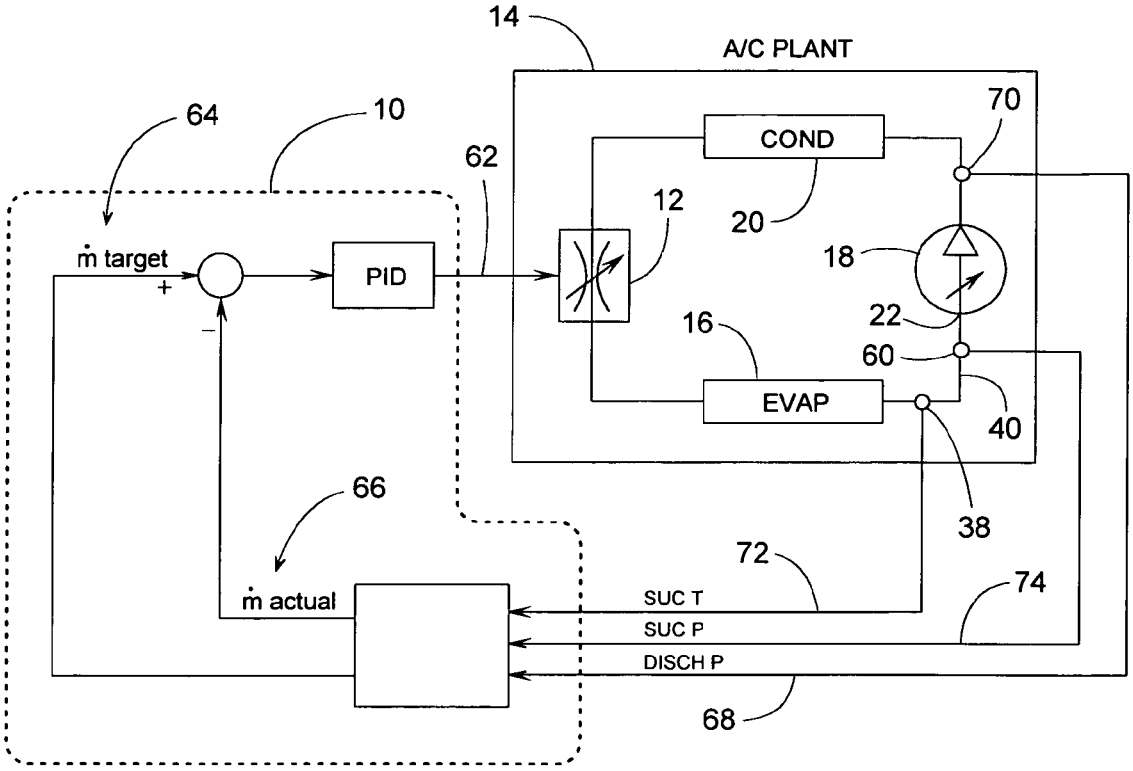
FIG. 1 is a schematic diagram of a chiller according to at least one embodiment of the invention.

FIG. 1 schematically illustrates a controller 10 that regulates an electronic expansion valve 12 of a chiller 14 to maintain the refrigerant leaving a DX evaporator 16 at a desired or target superheat that is minimally above saturation. Electronic expansion valve 12 is schematically illustrated to represent any electrically adjustable flow restriction of which there are many different types well known to those of ordinary skill in the art. Controller 10 is schematically illustrated to represent any electronic or programmable device capable of performing the steps specified in this description and the claims. Examples of controller 10 include, but are not limited to, a computer, microprocessor, analog circuit, digital circuit, and various combinations thereof.

Chiller 14 is schematically illustrated to represent any refrigerant system that includes a compressor, a heat exchanger such as an evaporator for absorbing heat, a heat exchanger such as a condenser for releasing heat, and an expansion valve for providing a controllable flow restriction between the condenser and evaporator. Although in its simplest form chiller 14 comprises a compressor 18, a condenser 20, expansion valve 12, and evaporator 16, chiller 14 can be much more complicated. Chiller 14, for instance, may include multiple compressors for varying load, a variable capacity compressor, multiple or variable speed fans associated with evaporator 16 or condenser 20, reversing capability (heat pump) for switching between heating and cooling modes, etc.

In operation, the compressor 18 raises the pressure and temperature of gaseous refrigerant and discharges the refrigerant gas into the condenser 20. A first external fluid, such as water or air, cools and condenses the refrigerant inside the condenser 20. Expansion valve 12 conveys the condensed refrigerant from the higher-pressure condenser 20 to the lower-pressure evaporator 16. Upon passing through valve 12 and entering evaporator 16, the refrigerant begins expanding and cooling. The cool refrigerant passing through evaporator 16 absorbs heat from a second external fluid that vaporizes the refrigerant before the refrigerant returns to a suction inlet 22 of compressor 18 for recompression. Depending on whether the system is used for heating or cooling, the heat released or absorbed by condenser 20 and evaporator 16 can be useful or waste heat.

Figure 2:
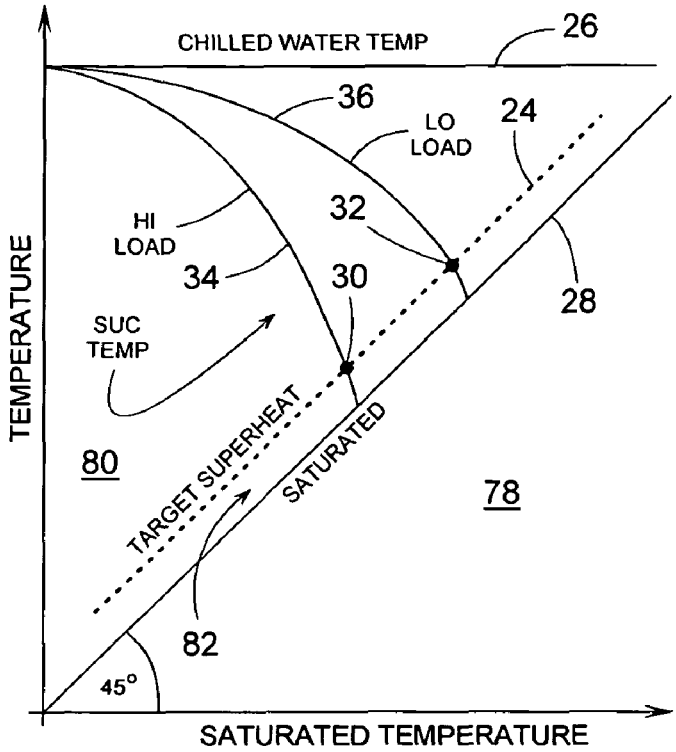
FIG. 2 is a graph showing how the suction temperature may vary for the chiller of FIG. 1.

For maximum efficiency and compressor reliability, chiller 14 preferably operates where the suction temperature of the refrigerant leaving evaporator 16 is at a target superheat as indicated by line 24 of FIG. 2. Line 26 of FIG. 2 represents the temperature of the fluid being cooled by evaporator 16. The target superheat may be where the suction temperature, for example, is two degrees Fahrenheit above saturation, wherein the saturation threshold is represented by line 28. The suction temperature is, for example, preferably at a point 30 at full load and at a point 32 at reduced load (e.g., partially unloaded compressor, fewer operating compressors, etc.). Although the actual suction temperature may vary along a curve 34 under full load, controller 10 regulates expansion valve 12 to bring the suction temperature to point 30. Likewise, the suction temperature may fluctuate along a curve 36 during part-load operation.

To sense the suction temperature and provide controller 10 with suction temperature feedback 72, a conventional temperature sensor 38 can be installed generally between evaporator 16 and suction inlet 22. Sensor 38 can be attached directly to evaporator 16 near its outlet, attached to compressor 18 near its inlet, or attached to a refrigerant line 40 running between evaporator 16 and compressor 18.

To sense the suction pressure and provide controller 10 with suction pressure feedback 74 corresponding to saturated suction temperature for the calculation of superheat, a conventional pressure sensor 60 can be installed somewhere downstream of valve 12 and upstream of compressor inlet 22. Pressure sensor 60 is preferably installed downstream of evaporator 16 to avoid having to consider the pressure drop across evaporator 16 although the pressure sensor 60 could be installed elsewhere if the pressure drop was accounted for.

Figure 3:
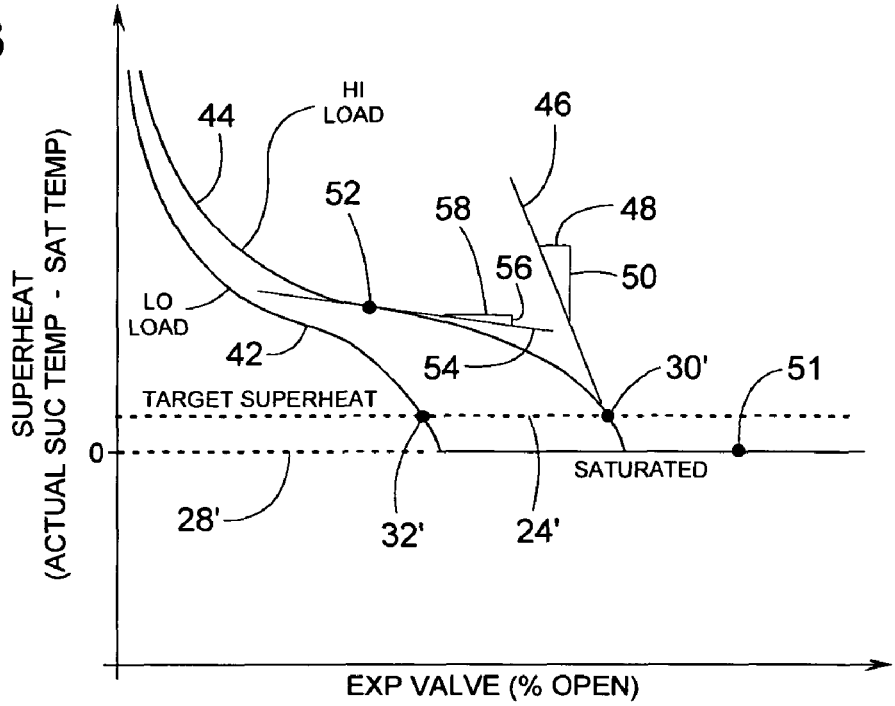
FIG. 3 is a graph showing how the level of superheat may vary in response to the expansion valve.

The challenge of maintaining the operation of chiller 14 on target superheat line 24 may be better understood with reference to FIG. 3. In FIG. 3, curves 42 and 44, lines 24' and 28', and points 30' and 32' respectively correspond to curves 36 and 34, lines 24 and 28, and points 30 and 32 of FIG. 2. A relatively steep slope 46 or tangent of curve 44 at point 30' indicates that a small change 48 in the opening of expansion valve 12 causes a significant change 50 in the level of superheat. Thus, the rate in which controller 10 adjusts the opening of valve 12 is preferably rather slow to avoid overshooting point 30 or 30'. If this slow responsiveness is maintained when the superheat rises to a point 52, which is on a more level portion of curve 44, controller 10 and valve 12 may bring the suction temperature back to point 30 or 30' at an unnecessarily slow rate. With a slope 54 or tangent of curve 44 at point 52 being more level than slope 46, it is clear that even a small change 56 in superheat requires a substantial change 58 in the opening of valve 12.

When operating in the saturated range, such as at a point 51, it may take an even larger, more drastic change in the opening of valve 12 to return to the target superheat because the slope of curve 44 and 42 at point 51 is essentially zero.

Although conceivably the gain or responsiveness could be adjusted depending on what point along curve 44 that chiller 14 is operating, in reality that may be impractical, as the shape of the curve can change. The shape, for instance, can change from curve 44 to curve 42 depending on the load and numerous other factors.

Rather than regulating valve 12 directly in response to the superheat, controller 10 regulates valve 12 in response to suction pressure feedback 74 from pressure sensor 60 and suction temperature feedback 72 from temperature sensor 38. In response to suction pressure feedback 74 and suction temperature feedback 72, controller 10 provides an output signal 62 that commands expansion valve 12 to convey a target mass flow rate, which will drive the suction temperature at an appropriate rate toward a desired saturation temperature that achieves the target superheat.

Controller 10 generates output signal 62 upon comparing a target mass flow rate 64 to the actual mass flow rate 66 through valve 12. Although the actual mass flow rate 66 can be measured directly using a flow meter, in a currently preferred embodiment, controller 10 calculates the actual flow rate as being the product of the known flow coefficient of valve 12 times the square root of a pressure differential across valve 12. Determining the pressure differential across valve 12 may involve sensing a discharge pressure (discharge pressure feedback 68) via a pressure sensor 70 installed somewhere downstream of compressor 18 and upstream of valve 12. The pressure drop across valve 12 would then be approximated by the difference between the discharge pressure (signal 68) and the suction pressure (signal 74). The actual flow coefficient of valve 12 would of course be a function of the degree to which valve 12 is open, however, controller 10 is aware of the valve's degree of opening, as it is controller 10 that commands the operation of valve 12.

Controller 10 calculates the target mass flow rate 64 as being the product of the actual mass flow rate 66 times a pressure ratio, wherein the pressure ratio is a function of the suction pressure (signal 74) and the suction temperature (signal 72). More specifically, the ratio can be considered as a desired saturation pressure divided by the sensed suction pressure. Since refrigerants have a known relationship between their saturation temperature and their saturation pressure, the desired saturation pressure is determined based on its corresponding desired saturation temperature, wherein the desired saturation temperature is calculated. The desired saturation temperature equals the suction temperature (sensed by temperature sensor 38) minus a predetermined desired target superheat (e.g., 2-degrees Fahrenheit).

An alternative to the use of a pressure ratio is the use of a density ratio, such that the target mass flow rate is the product of the actual mass flow rate times the density ratio. Specifically, the density ratio can be considered as the density of the desired suction refrigerant state divided by the density of the measured suction refrigerant state. The density ratio is an "ideal" alternative because the density ratio is related directly and linearly to the mass flow rate through a compressor operating at a constant volumetric flow rate. The density of the measured suction refrigerant state can be determined from the pressure and temperature of a vapor measured in the suction line, while the density of the desired suction refrigerant state can be determined from the suction pressure, the suction temperature and the superheat setpoint. Compressors in chillers with DX evaporators typically operate on the principle of a fixed suction volumetric flow rate corresponding to any particular load adjustment. For a single refrigerant circuit with non-branched flow, the mass flow rate through the compressor must equal the mass flow rate through the expansion valve over time. The pressure ratio can be computed without performing refrigerant density computations and is an adequate approximation of the density ratio.

Figure 4:
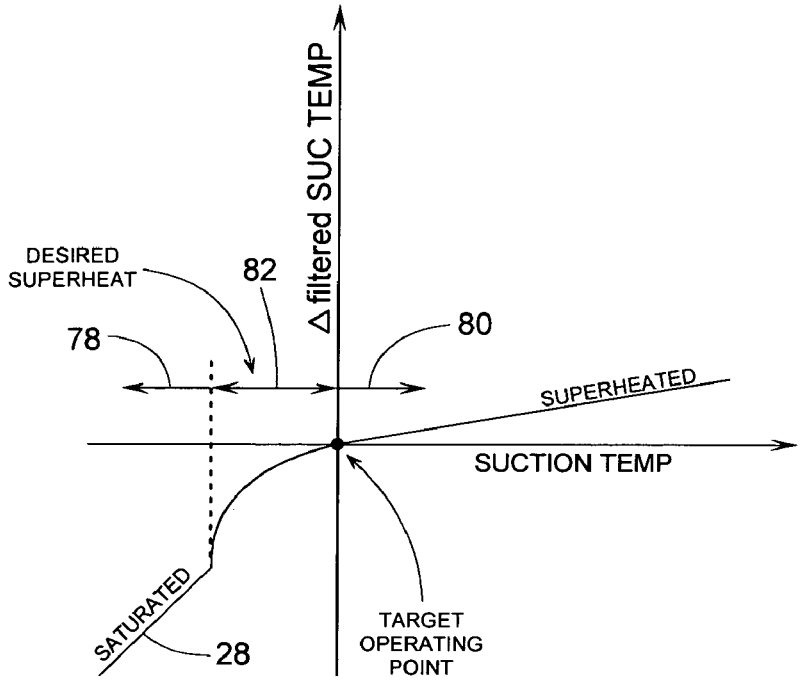
FIG. 4 is a graph of a recursive formula that relates a delta filtered suction temperature to the actual suction temperature, whereby a filtered suction temperature can be calculated recursively based on the plotted delta filtered suction temperature.
Figure 5:
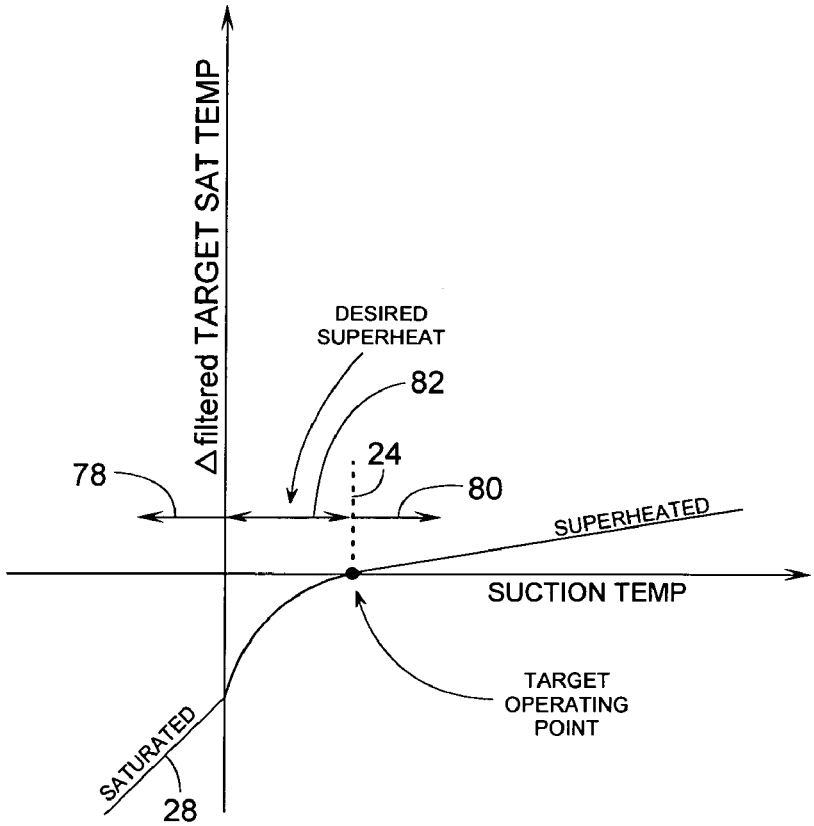
FIG. 5 is a graph showing how a filtered target saturation temperature can vary with suction temperature.

To ensure that valve 12 responds at an appropriate rate regardless if chiller 14 is operating in a saturated range 78 (on line 28 of FIG. 2), in a superheated range 80 (appreciably above line 24), or within a desired superheat range 82 (substantially on line 24), controller 10 determines the desired saturation temperature (for ultimately determining the target mass flow rate) by asymmetrically filtering (i.e., asymmetrically dampening) a temperature-related variable. Controller 10, for instance, asymmetrically filters the sensed suction temperature (to generate the filtered suction temperature) or asymmetrically filters the desired saturation temperature (to generate the desired filtered saturation temperature). FIGS. 4 and 5 show how the change in the filtered value varies as an asymmetric and nonlinear function of suction temperature. Regardless of whether the filtering or dampening is applied to the sensed suction temperature or the target saturated temperature, the end result is the same. Controller 10 adjusts expansion valve 12 more rapidly when chiller 10 operates in superheated range 80 than when operating in the desired superheat range 82, and controller 10 adjusts expansion valve 12 less rapidly when chiller 10 operates in the superheated range 80 than when operating in the saturated range 78.

Figure 6:
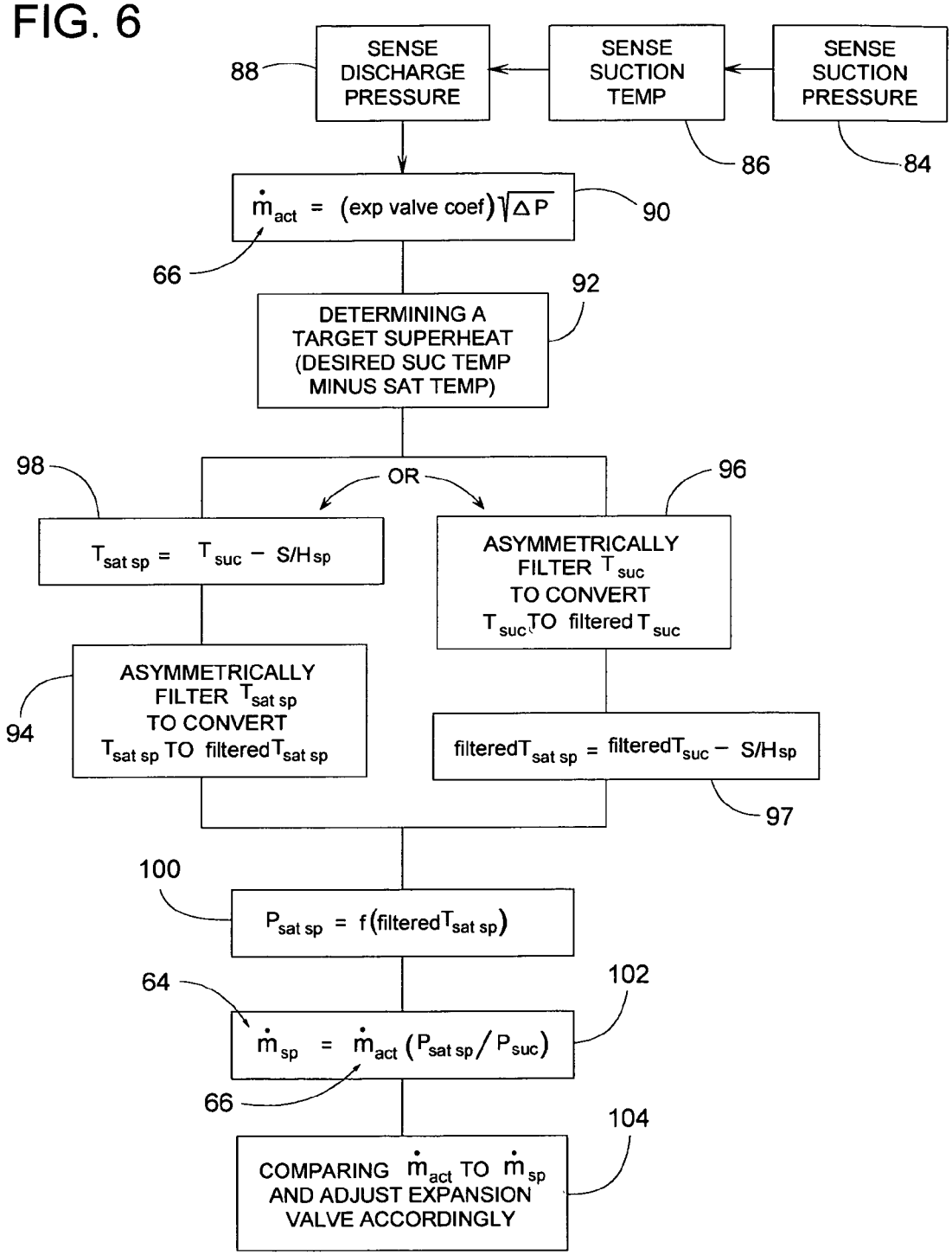
FIG. 6 is a block diagram illustrating various operational steps performed physically or carried out logically according to a control algorithm.

The above-described operational steps performed physically or carried out logically according to a control algorithm of controller 10 are illustrated in FIG. 6. The steps are not necessarily performed in discrete, independent steps; the steps are not necessarily done in the order in which they are shown; and not all of the illustrated steps are necessarily required to accomplish the invention.

A block 84 represents the step of sensing the suction pressure via pressure sensor 60. A block 86 represents the step of sensing the suction temperature via temperature sensor 38. A block 88 illustrates pressure sensor 70 sensing the discharge pressure. The actual mass flow rate through valve 12 (or an equivalent mass flow through evaporator 16, condenser 20, or compressor 18) can be measured in various ways including, but not limited to, as discussed previously, by using a flow meter or by referring to certain known performance characteristics of compressor 18. In block 90, the actual mass flow rate is calculated generally as the square root of the pressure drop across valve 12 (approximated by the square root of the difference between the discharge pressure and the suction pressure) times a known operating characteristic of valve 12. A block 92 illustrates the step of determining a target superheat, which can be a predetermined value permanently stored in controller 10, or the superheat value can be a user-selected value.

A block 98 represents the step of determining a desired saturation temperature ($T_{sat\ sp}$) based upon the suction temperature ($T_{suc}$) decreased by the target superheat ($S/H_{sp}$), and a block 94 illustrates asymmetrically filtering the desired saturation temperature to achieve a desired filtered saturation temperature (filtered $T_{sat\ sp}$). Alternatively, a block 96 illustrates asymmetrically filtering a sensed reading of the suction temperature to achieve a filtered suction temperature (filtered $T_{suc}$), and a block 97 represents the step of determining a desired filtered saturation temperature (filtered $T_{sat\ sp}$) based upon the filtered suction temperature (filtered $T_{suc}$) decreased by the target superheat ($S/H_{sp}$).

Either blocks 98 and 94 or blocks 96 and 97 can be used for selectively dampening the response of valve 12 so that the expansion valve is more responsive under certain conditions, such as when the refrigerant is excessively superheated and even more responsive when the refrigerant is saturated or nearly so.

A block 100 illustrates the desired saturation pressure ($P_{sp}$) being determined based on its known relationship to its corresponding desired filtered saturation temperature (filtered $T_{sat\ sp}$). A block 102 shows the step of determining the target mass flow rate ($m_{sp}=m_{act}(P_{sp}/P_{suc})$) through expansion valve 12 that could achieve the target superheat, wherein the target mass flow rate is at least partially determined based on the suction pressure ($P_{suc}$). An alternative implementation of block 102 determines the target mass flow rate ($m_{sp}=m_{act}(\rho_{sp}/\rho_{suc})$) through expansion valve 12 that could achieve the target superheat, wherein the target mass flow rate is at least partially determined based on the suction density ($\rho_{suc}$) A block 104 shows the step of adjusting or controlling expansion valve 12 to help maintain the actual mass flow rate at the target mass flow rate.

Blocks 102 and 104 are shown as separate steps in order to disclose the pressure ratio (alternatively density ratio) basis for determining the ratio of mass flow rate through the evaporator. For implementation, these blocks may be combined into one step of adjusting or controlling expansion valve 12 to maintain the actual suction pressure at the desired saturation pressure ($P_{sp}$). In such an implementation, the ratio of actual mass flow rate to suction pressure ($m_{act}/\rho_{suc}$) serves as a conversion factor from pressure units of the feedback signal to mass flow rate units of the expansion valve determining output.

Although the invention is described with reference to a preferred embodiment, it should be appreciated by those of ordinary skill in the art that other variations are well within the scope of the invention. Therefore, the scope of the invention is to be determined by reference to the following claims:

The invention claimed is:

1. A method of controlling a chiller that includes a compressor, a condenser, an expansion valve and an evaporator, wherein the expansion valve is adjustable between a closed position and open position, and the chiller circulates a refrigerant at an actual mass flow rate that may vary with a suction pressure between the expansion valve and a suction inlet of the compressor, a discharge pressure between the expansion valve and a discharge outlet of the compressor, and a suction temperature between the evaporator and the suction inlet of the compressor, wherein the refrigerant in the evaporator becomes saturated at a saturation temperature and a saturation pressure, the method comprising:

sensing the suction pressure; sensing the suction temperature;

determining a target superheat, wherein the target superheat is a desired difference between the saturation temperature and the suction temperature;

determining a target mass flow rate through the evaporator that could achieve the target superheat, wherein the target mass flow rate is at least partially determined based on the suction pressure;

determining an estimate of the actual mass flow rate through the evaporator; and adjusting the expansion valve to help maintain the actual mass flow rate at the target mass flow rate.

2. The method of claim 1, wherein the target mass flow rate is at least partially determined based upon the suction pressure and the suction temperature.

3. The method of claim 2, wherein the target mass flow rate is at least partially determined based on a density ratio, the density ratio is a desired target density divided by an actual density, the actual density is determined based on the suction pressure and the suction temperature, and the desired target density is determined based on the suction temperature, the suction pressure and the target superheat.

4. The method of claim 2, wherein the target mass flow rate is at least partially determined based upon a pressure ratio that includes the suction pressure and a desired saturation pressure, wherein the desired saturation pressure is determined based upon the suction temperature and the target superheat.

5. The method of claim 4, further comprising sensing the discharge pressure, and determining a pressure drop across the expansion valve based upon a difference between the suction pressure and the discharge pressure, wherein the actual mass flow rate through the evaporator is at least partially determined based upon the pressure drop.

6. The method of claim 5, further comprising:

determining a desired saturation temperature based upon the suction temperature and the target superheat; and asymmetrically filtering a sensed reading of the suction temperature to provide a filtered suction temperature that renders the expansion valve increasing responsive as the refrigerant in the evaporator becomes increasingly superheated.

7. The method of claim 5, further comprising:

determining a desired saturation temperature based upon the suction temperature and the target superheat; and asymmetrically filtering the desired saturation temperature to provide a filtered target saturated temperature that renders the expansion valve increasing responsive as the refrigerant in the evaporator becomes increasingly superheated.

8. The method of claim 5, wherein the chiller is operable in a saturated range, a superheated range, and a desired superheat range, such that:

i. in the saturated range, the suction temperature is substantially equal to the saturation temperature, ii. in the superheated range; the suction temperature is appreciably above a target temperature defined as the saturation temperature plus the target superheat, and iii. the desired superheat range is between the saturated range and the superheated range; wherein the expansion valve is adjusted more rapidly during the superheated range than during the desired superheat range, and the expansion valve is adjusted less rapidly during the superheated range than during the saturated range.

9. The method of claim 1, further comprising sensing the discharge pressure, and determining a pressure drop across the expansion valve based upon a difference between the suction pressure and the discharge pressure, wherein the actual mass flow rate through the evaporator is at least partially determined based upon the pressure drop.

10. The method of claim 1, further comprising:

determining a desired saturation temperature based upon the suction temperature and the target superheat; and asymmetrically filtering a sensed reading of the suction temperature to provide a filtered suction temperature that renders the expansion valve increasing responsive as the refrigerant in the evaporator becomes increasingly superheated.

11. The method of claim 1, further comprising:

determining a desired saturation temperature based upon the suction temperature and the target superheat; and asymmetrically filtering the desired saturation temperature to provide a filtered target saturated temperature that renders the expansion valve increasing responsive as the refrigerant in the evaporator becomes increasingly superheated.

12. The method of claim 1, wherein the chiller is operable in a saturated range, a superheated range, and a desired superheat range, such that:

i. in the saturated range, the suction temperature is substantially equal to the saturation temperature, ii. in the superheated range, the suction temperature is appreciably above a target temperature defined as the saturation temperature plus the target superheat, and iii. the desired superheat range is between the saturated range and the superheated range; wherein the expansion valve is adjusted more rapidly during the superheated range than during the desired superheat range, and the expansion valve is adjusted less rapidly during the superheated range than during the saturated range.

13. A chiller comprising:

a compressor having a suction inlet and a discharge outlet;

a condenser;

an expansion valve, adjustable between a closed position and an open position; an evaporator, wherein the refrigerant in the evaporator becomes saturated at a saturation temperature and a saturation pressure;

means for sensing a suction pressure between the expansion valve and the suction inlet of the compressor;

means for sensing a suction temperature between the evaporator and the suction inlet of the compressor;

means for determining a target superheat, wherein the target superheat is a desired difference between the saturation temperature and the suction temperature;

means for determining a target mass flow rate through the evaporator that could achieve the target superheat, wherein the target mass flow rate is at least partially determined based on the suction pressure;

means for determining an estimate of an actual mass flow rate through the evaporator; and means for adjusting the expansion valve to help maintain the actual mass flow rate at the target mass flow rate.

* * * * *